United States Patent [19]

Sochor

[11] 3,986,766

[45] Oct. 19, 1976

[54] PLUGGABLE EDGE HEADER ASSEMBLY

[75] Inventor: Jerzy Sochor, Willow Grove, Pa.

[73] Assignee: Elco Corporation, El Segundo, Calif.

[22] Filed: Sept. 24, 1975

[21] Appl. No.: 616,385

Related U.S. Application Data

[63] Continuation of Ser. No. 467,603, May 6, 1974, abandoned.

[52] U.S. Cl. ..... 339/176 M; 339/217 S

[51] Int. Cl.[2] ..... H01R 13/40

[58] Field of Search ..... 339/17–19, 339/174, 176, 195, 196, 198, 217, 252

[56] References Cited

UNITED STATES PATENTS

| | | | |
|---|---|---|---|
| 2,446,232 | 8/1948 | Koenig | 339/18 R |
| 2,457,703 | 12/1948 | Merkel | 339/217 S |
| 2,669,702 | 2/1954 | Klostermann | 339/196 M |
| 2,699,534 | 1/1955 | Klostermann | 339/176 MP |
| 3,059,211 | 10/1962 | Thomas et al. | 339/176 MF |
| 3,069,753 | 12/1962 | Lalmond et al. | 339/176 MF |
| 3,101,231 | 8/1963 | Klostermann | 339/17 L |
| 3,365,694 | 1/1968 | Parker | 339/91 R |
| 3,601,746 | 8/1971 | Teagno | 339/18 B |
| 3,663,930 | 5/1972 | Henschen et al. | 339/252 P |
| 3,696,319 | 10/1972 | Olsson | 339/176 MF |

FOREIGN PATENTS OR APPLICATIONS

| | | | |
|---|---|---|---|
| 1,492,313 | 7/1967 | France | 339/176 M |
| 1,370,109 | 7/1964 | France | 339/198 P |
| 815,208 | 10/1951 | Germany | 339/252 P |
| 469,375 | 4/1969 | Switzerland | 339/17 L |
| 858,692 | 1/1961 | United Kingdom | 339/176 P |
| 1,200,801 | 8/1970 | United Kingdom | 339/176 MF |

*Primary Examiner*—Joseph H. McGlynn
*Attorney, Agent, or Firm*—Joel M. Freed; Gregory J. Battersby

[57] ABSTRACT

A plug for connecting a plurality of individual elongate flexible conductors with a card edge connector in which an insulating housing is provided with a substantially planar beam for carrying a plurality of electrically conductive contact members that are each electrically connected with one of the conductors.

6 Claims, 9 Drawing Figures

FIG. 2
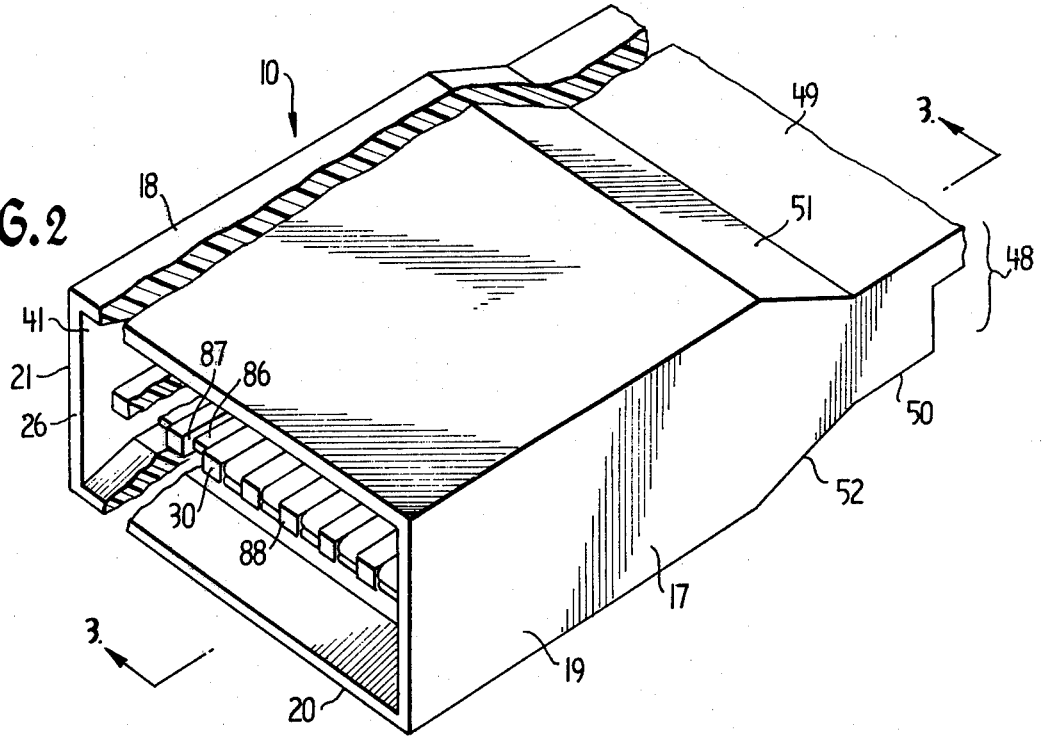
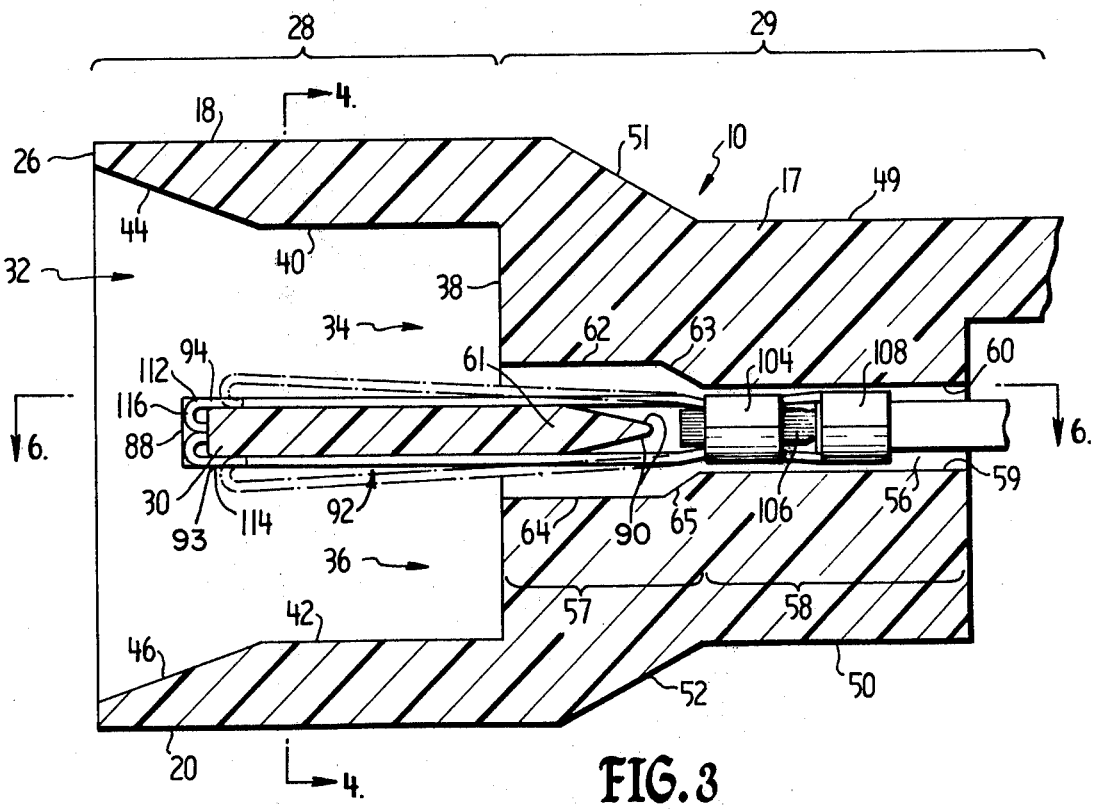
FIG. 3

PLUGGABLE EDGE HEADER ASSEMBLY

This is a continuation, of application Ser. No. 467,603, filed May 6, 1974, now abandoned.

BACKGROUND OF THE INVENTION

This invention relates to electrical connectors. More particularly this invention relates to electrical connectors for interconnecting a plurality of individual elongate flexible conductors and a card edge connector.

Present conventional systems having card edge connector capability, wherein a card edge connector is mounted on a back panel, card cage or other suitable mounting arrangement, are capable of receiving various printed circuit "daughter" boards and providing appropriate electrical connections thereto. In the case of back panels, special provision, independent of the card edge connector, usually is made for supplying power to the back panel. For example, rack and panel connectors including a plug, a plurality of contacts, and a plurality of cables crimped or soldered to the connectors, may be mated with receptacles specifically provided on the back panel to supply the power. The need for special accommodation in this regard has a somewhat limiting effect on system flexibility.

In addition, present systems employing card edge connectors do not include provisions for connections between wires and the housed contacts of card edge connectors. Again, it will be apparent that this somewhat limits the flexibility of the system.

The present invention recognizes the desirability of avoiding a special provision for input-output capability while taking advantage of the card edge connector capability present in such systems for input-output functions.

At the same time, the present invention embodies recognition of the desirability of enhancing the flexibility of card edge connector systems by establishing direct compatability of the housed contacts of card edge connectors with wires, cables, or other elongate flexible conductors.

OBJECTS AND SUMMARY OF PREFERRED FORMS OF INVENTION

It is, therefore, a general object of the present invention to provide a novel method and apparatus that enhances the flexibility of card edge connectors.

It is another object of the present invention to provide such a novel method and apparatus that significantly extends the usefulness of card edge connectors particularly when associated with a back-panel.

It is a further object of the present invention to provide such a novel method and apparatus that establishes direct compatability with wires, cables or other elongate flexible conductors.

It is also a general object of the present invention to provide a novel plug which is adapted to connect a plurality of individual elongate flexible conductors to a conventional card edge connector.

Another general object of this invention is to provide a novel plug for a plurality of such conductors which eliminates the need for soldered connections with the individual conductors.

A more specific object of the invention is to provide a novel plug with a generally planar beam whose thickness and lateral dimensions resemble an end portion of a conventional circuit board, thereby permitting a conventional card edge connector to serve as a receptacle for the plug.

A further object of the invention is to provide a novel plug having a generally planar beam that assists in the uniform alignment of a plurality of electrical contacts, each of which is connected to one of a plurality of conductors.

An additional object of the invention is to provide a novel plug with a generally planar beam which carries electrical contacts on the planar surfaces thereof.

Yet another object of the invention is to provide a novel plug in which a beam is provided both to spread bifurcations of bifurcated electrical contacts and to facilitate alignment of the contacts in the plug.

Still another object of this invention is to provide a novel plug for a plurality of conductors wherein a generally planar beam is recessed from one edge of the plug to protect exposed surfaces of electrical contacts carried by the beam.

A further object of this invention is to provide a novel plug having a plurality of openings which assist the alignment of electrical contacts each of which is connected to a conductor while the contacts being inserted into the plug.

A still further object of the invention is to provide a novel one-piece plug having removable electrical contacts whereby each one of a plurality of elongate flexible conductors may be individually connected to a contact and subsequently inserted into the one-piece plug.

A yet still further object of this invention is to provide novel removable electrical contacts in a plug for a plurality of elongate flexible conductors so that an individual contact may be replaced when damaged without the necessity of removing all contacts and without the need for replacing all contacts of the plug.

Still another object of the invention is to provide a novel plug for a plurality of conductors wherein removable electrical contacts are crimpable so that a rapid inexpensive connection between each contact and a corresponding conductor may be accomplished without the need for soldering while simultaneously ensuring uniformity of contact orientation and uniformity of electrical connection between individual contacts and the respective conductors.

An additional object of the invention is to provide novel bifurcated electrical contacts for use in a plug for a plurality of conductors in order to allow a redundant electrical connection between the conductors and a receptacle mating with the plug. In this connection, it is also an object of the invention to provide a novel locking means on each bifurcated finger of the individual contacts whereby the contacts may be removably secured in the plug.

A further object of the invention is to provide a plug for a plurality of conductors in which bifurcated contacts are each provided with a pair of flat fingers such that the contacts present a low profile to external elements which might otherwise damage the contacts.

A novel plug for connecting a plurality of elongate flexible conductors to a card edge connector according to a preferred embodiment of the invention intended to substantially accomplish the foregoing and many other objects includes an insulating housing having both a generally planar grooved beam and a shroud peripherally disposed therearound extending from one end of the housing. The housing also includes a plurality of openings which are substantially aligned with grooves of the beam for receipt of a corresponding plurality of removable electrically conductive bifurcated contacts. Each contact includes a pair of fingers which are spread apart by the beam during insertion of the contact into the housing and which are received by grooves of the beam thus separating adjacent contacts. Both fingers of a contact include either a curved end or a resilient buttress member to engage a part of the housing and retain the contact therein. For connection of each contact with a conductor crimpable ears are provided at one end of each contact.

The plurality of conductors may be provided by a multiconductor cable for transferring power to or from a back panel, and the plug may be connected to a card edge connector structure mounted on the back panel to thereby complete one path for input or output of power thereto or therefrom.

BRIEF DESCRIPTION OF THE DRAWINGS

Other objects and advantages of the present invention will become apparent with reference to the following detailed description of preferred embodiments of the invention in connection with the accompanying drawings wherein like reference numerals have been applied to like elements, and in which:

FIG. 2 is another perspective view depicting the plug of the present invention;

FIG. 3 is a cross-sectional view taken along section line 3—3 in FIG. 2;

DETAILED DESCRIPTION

Figure 1:
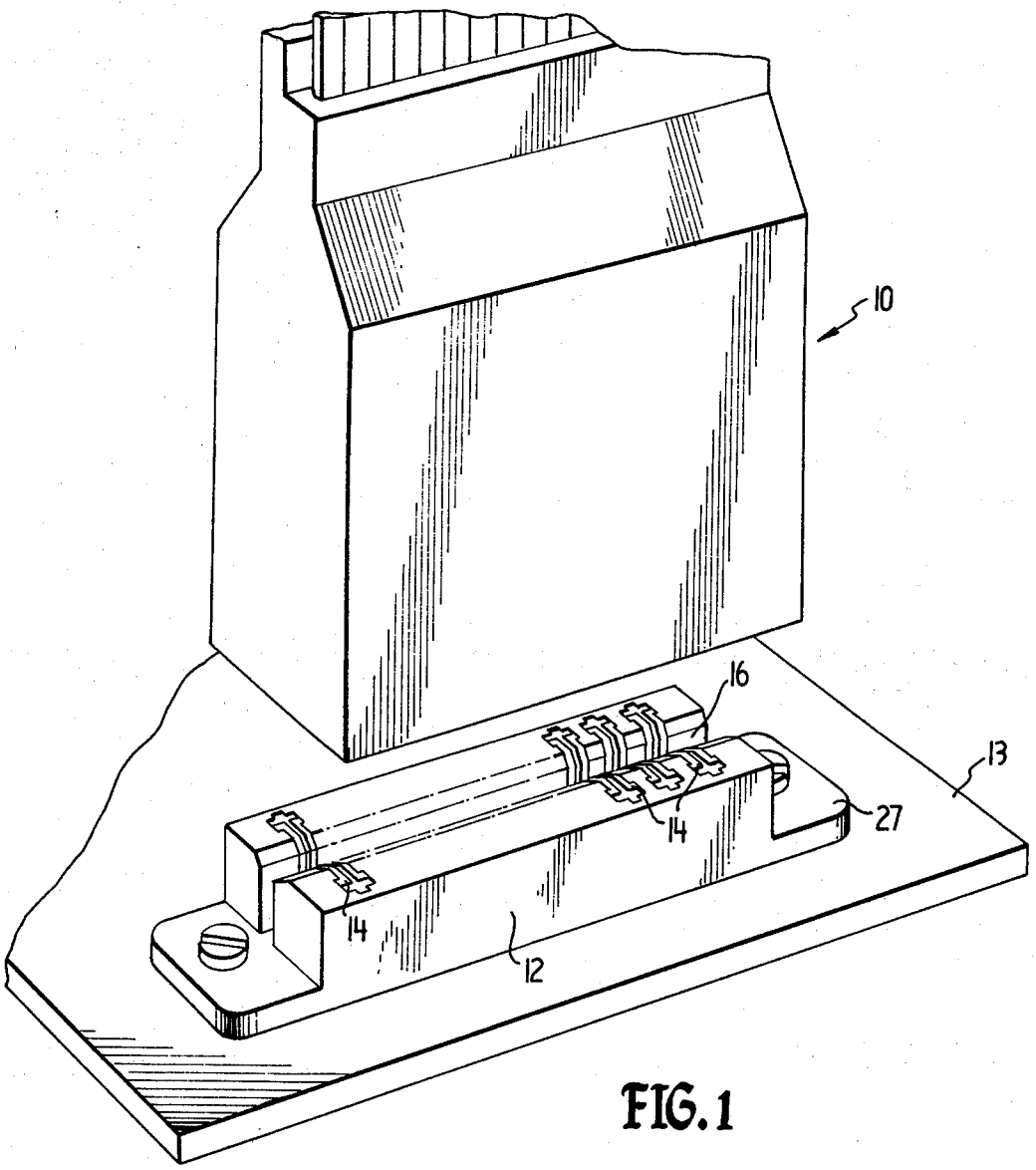
FIG. 1 is a perspective view of a multi-conductor plug aligned with a card edge connector with which the plug is designed to mate in accordance with the present invention.

With reference to FIG. 1, a multiconductor plug 10 may be seen illustrated in position prior to connection with a card edge connector 12 which is mounted on a conventional back panel 13. The card edge connector includes connector contacts 14 and a generally longitudinal opening 16 which is operable to receive a conventional printed circuit board and which will accomodate the plug 10 of the instant invention.

As seen in FIG. 2, the plug 10 includes a housing 17 having a generally rectangular cross-section, defined by generally planar exterior surfaces 18, 19, 20 and 21. The plug 10 may be provided with a front face 26 which abuts surfaces 27 (see FIG. 1) of the card edge connector 12 when the plug 10 is fully mated therewith. The plug 10 is preferably fabricated from electrically insulating material for reasons which will become clear.

In FIG. 3, the housing 17 is depicted as comprising a shroud 28 and a body portion 29. The shroud 28 extends forwardly of the body portion 29 and may have a generally rectangular shape as illustrated. The shroud 28 defines a connector receiving recess 32. As can be seen from FIG. 2, the connector recess 32 has a card edge defining means comprising a generally planar beam 30 provided therein such that shroud 28 extends beyond the beam 30.

Returning to FIG. 3 the generally planar beam 30 is depicted as being disposed substantially centrally of the connector recess 32 for the substantially entire transverse extent thereof. Accordingly, connector recess 32 is divided into two cavities 34, 36 which extend inwardly to rear surface 38 and have side walls 40, 41, 42, 43 (see FIG. 4). The connector receiving recess 32 (FIG. 3) includes a pair of chamferred surfaces 44, 46 disposed at the forward edge of shroud 28 adjacent to front face 26 thereby providing inclined surfaces which facilitate the positioning and guiding of the plug 10 with respect to card edge connector 12 during connection therebetween.

if desired, the plug 10 may include (see FIG. 2) a top reduced width portion 48 which is defined by generally planar surfaces 49, 50. Between the exterior surface 18, 20 and the surfaces 49, 50, transition surfaces 51, 52 may be provided to avoid unnecessarily weakening the junction between the shroud 28 and the body portion 29. Such a reduced width portion 48 may be desirable in applications where it is necessary to provide low weight, minimum external size or maximum clearance between adjacent plugs. In addition the portion 48 may be useful to facilitate gripping for insertion and removal of plug 10 from connector 12.

The plug 10 may be provided with a plurality of longitudinally extending openings 56 (as illustrated in FIG. 3) each of which includes a front portion 57 in communication with both cavities 34, 36 and a rear portion 58. The front portion 57 includes sidewalls 62, 63, 64, 65 and rear portion 58 includes sidewalls 59, 60.

The sidewalls 62, 64 are spaced farther apart than sidewalls 59, 60 to provide additional clearance around extension 61 of beam 30 which protrudes into the first portion 57 of each opening 56. While sidewalls 63, 65 are illustrated as being generally planar, it should be noted that these are transition surfaces and need not be planar or angled as illustrated in FIG. 3.

Figure 6:
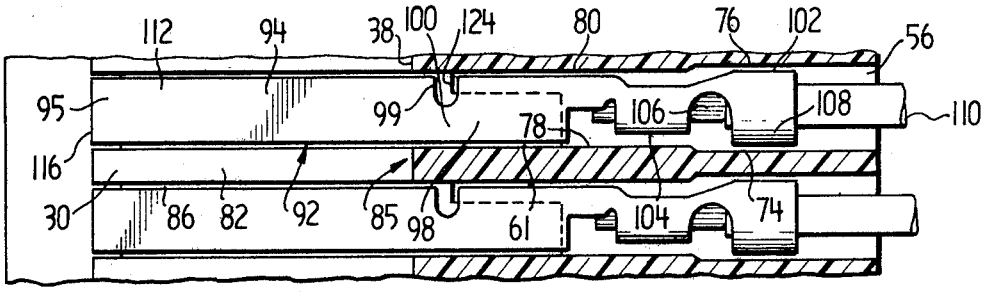
FIG. 6 is a plan view taken along line 6—6 of FIG. 3.

Each opening 56 (as best seen in FIG. 6) also includes walls 74, 76, 78, 80. The different spacing between walls 74, 76 and walls 78, 80 is useful to accomodate differently sized cross-sections of bifurcated contact member 92 to be described.

Figure 4:
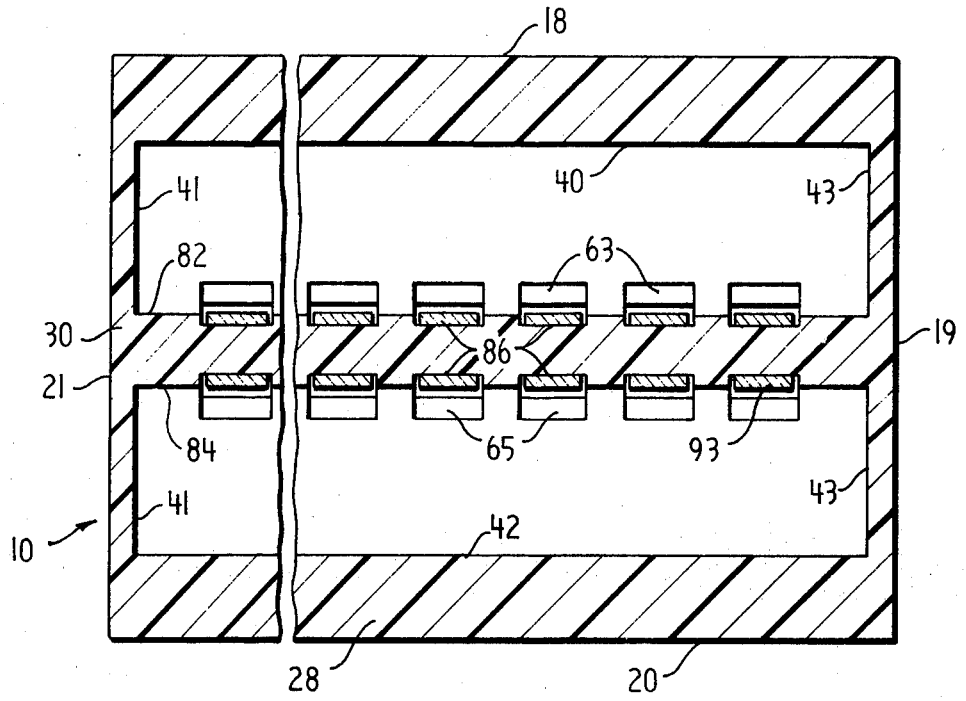
FIG. 4 is a cross-sectional view taken along line 4—4 of FIG. 3.

Returning to FIG. 3 the electrically insulating beam 30 includes a front end 88 and the previously described rearwardly directed extensions 61 each of which have a pair of converging chamferred surfaces 90. As illustrated in FIG. 4, the generally planar beam 30 includes a generally planar upper surface 32 and a generally planar lower surface 84. The surfaces 82, 84 are generally parallel to one another and are, preferably, substantially perpendicular to surface 88. If desired, the beam 30 may be integrally attached to side walls 41, 43 of the connector receiving recess 32 to further diminish the potential for flexure of the beam. It will, however, be appreciated that most conventional card edge connectors have board receiving openings with closed ends, rather than the open-ended longitudinal opening 16 illustrated in FIG. 1. For use with such card edge connections, the beam 30 of the plug 10 could, of course, be detached from the side walls 41, 43 so as to accommodate the closed end of the card edge connector.

The illustrated beam 30 is connected to the body portion 29 of plug 10 at the rear surface 38 of the recess 32 as illustrated in FIG. 6 at 85. In the illustrated embodiment, the beam 30 is integral with both the body portion 29 and the shroud 28 to provide a very rigid support for the beam 30.

If desired, a plug 10 may be made without the shroud 28 to surround the card edge connector 12 when the plug is inserted therein. In this event, the connection between the beam 30 and the surface 38 should be adequate to maintain the beam 30 in a substantially rigid posture without allowing an inordinate degree of flexure. In addition, the surface 38 will then comprise an abutment surface which engages the top of the card edge connector 12 and thereby limits the penetration of beam 30 thereinto.

As best seen in FIG. 2, the generally planar upper surface 82 of beam 30 may be provided with a plurality of parallel alignment and lead-in grooves 86 each of which is longitudinally aligned with one of the longitudinal openings 56 for purposes which will later become apparent. The generally planar lower surface 84 may, similarly, include parallel grooves 86 which are aligned both with the grooves 86 of the upper surface 82 and with the longitudinal openings 56. To connect corresponding grooves 86 in beam surfaces 82, 84, the notches 87 may be provided at the the front end 88 of the beam 30. These notches 87 also help secure contact members 92 in the plug as will be more fully described.

Figure 8:
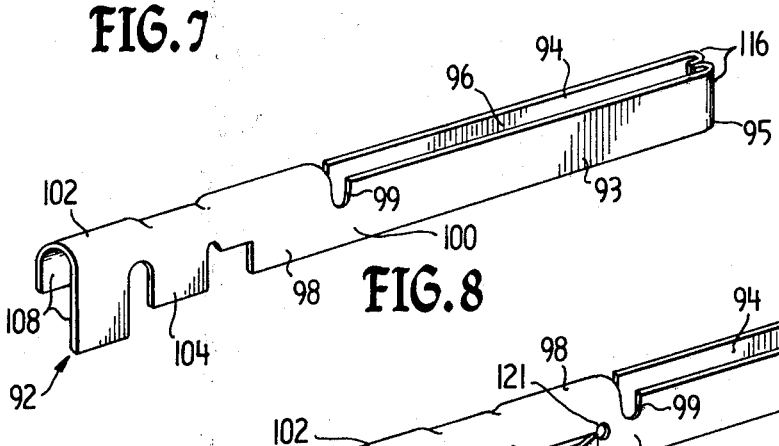
FIG. 8 is a perspective view of a contact member according to the present invention.
Figure 9:
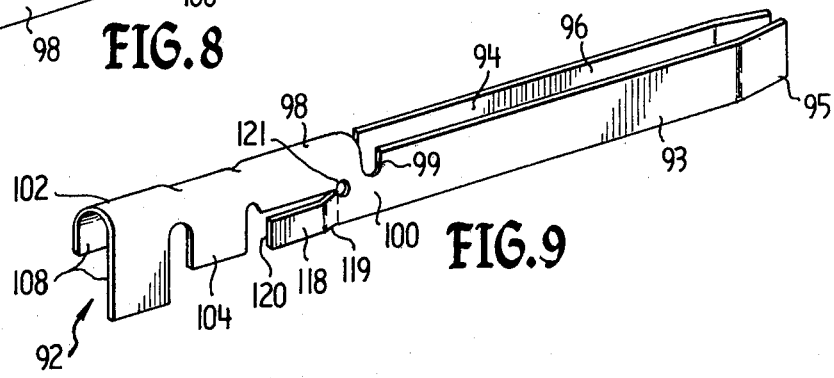
FIG. 9 is a perspective view of a second embodiment of a contact member according to the present invention.

The plug 10 includes a plurality of bifurcated contact members 92 one embodiment of which is illustrated in FIG. 8 and a second embodiment of which is illustrated in FIG. 9. Each contact member 92 is preferably fabricated entirely from electrically conductive material.

Each contact member 92 includes a pair of parallel fingers 93, 94 disposed at a first end 95 thereof. The fingers 93, 94 define a longitudinally extending bifurcating slot 96 therebetween which extends from the first end 95 of contact member 92 to a U-shaped central portion 98 thereof. At the termination of slot 96 adjacent the central portion 98, a generally transverse slot 99 is preferably provided to define a reduced cross-sectional area 100 on each finger 93, 94. The reduced area 100 establishes a preferred pivot about which each finger 93, 94 may flex during insertion into the plug 10.

While the fingers 93, 94 are illustrated in FIGS. 8 and 9 as having a flat transverse cross-sectional configuration, other configurations may be readily envisioned which would also be suitable, e.g., arcuate configurations.

Each bifurcated contact member 92 may be provided with means to connect an elongate flexible conductor therewith. Where the elongate flexible conductor is a wire as illustrated, the second end 102 of each contact member 92 is provided with a pair of transversely extending crimpable ears 104 as may be seen in FIG. 8. In addition, the second end 102 may include a second pair of crimpable ears 108. While the crimpable ears 104, 108 are illustrated in pairs it will be clear to those skilled in the art that the crimpable portions of each contact member 92 may each constitute a single crimpable ear or a plurality of crimpable ears. The ears 104, 108 are suitable for crimping by machine or hand.

From FIG. 6 the connection between one contact member 92 and one of a plurality of insulated, elongate flexible conductors in the form of a wire will be apparent. More specifically, the first pair of crimpable ears or deformable elements 104 may be crimped to an exposed portion 106 of a conductor to establish both electrical and mechanical contact therebetween. The second pair of crimpable ears or deformable elements 108 may be crimped to insulation 110 surrounding the conductor 106 to establish a mechanical connection therebetween. Accordingly, the crimpable ears 104, 108 permit a mechanically and electrically effective connection of each contact member 92 and the insulated conductor associated therewith.

By virtue of the above described configuration of each contact member 92, each finger 93, 94 thereof is thus in electrical contact with conductor 106 making possible a redundant electrical contact between each conductor 106 and the card edge connector 12 when the plug 10 is inserted thereinto.

As best illustrated in FIG. 8 a preferred embodiment of the invention includes a resilient hook means 116 disposed at the first end 95 of each contact member 92; one hook means 116 being provided for each finger to engage the front edge 88 of the beam 30. Each hook means 116 may comprise a generally J-shaped curved end of the associated finger 93, 94. When a contact member 92 is fully inserted into the plug 10 (see FIG. 3), each hook means 116 is in overlapping relationship with front edge 88 and is disposed within a notch 87 of the beam 30.

In a second embodiment of the contact member 92 (see FIG. 9) the central portion 98 may be provided with a pair of buttress members or lances 118. One end 119 of each lance member 118 may be integral with the contact member and the second end 120 of each lance member may be resiliently spaced outwardly of the contact member 92. Adjacent the first end 119 of each lance member 118, a stress relieving hole 121 is preferably positioned to relieve classic stress concentrations associated with the ends of narrow slots such as that existing between lance member 118 and the central portion 98 of contact member 92.

Figure 5:
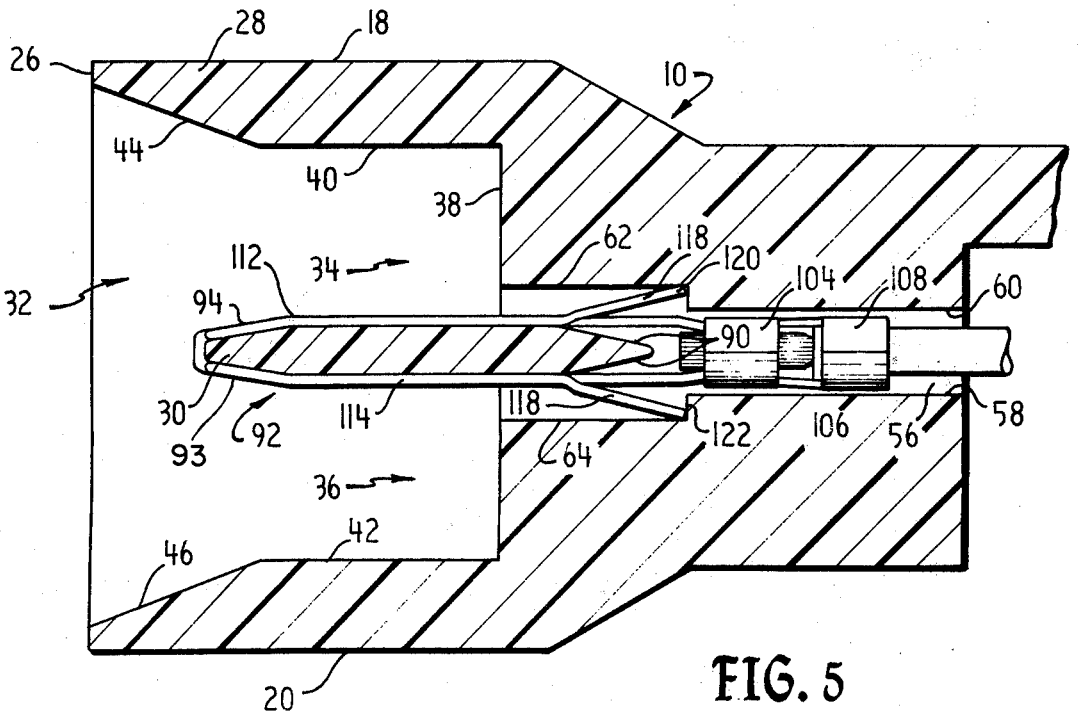
FIG. 5 is a cross-sectional view similar to FIG. 3 illustrating a second embodiment of the invention.

As shown in FIG. 5, the second end 120 of each lance member 118 is resiliently biased outwardly to engage a stepped surface 122 of the housing 17 when contact member 92 is fully inserted therein.

Thus, the hook means 116 and the lance members 118 comprise alternate embodiments of a latching means which removably retains each contact member 92 within plug 10 and which functions to substantially increase the pull-out force otherwise required to dislodge a contact member 92 from the plug 10.

Figure 7:
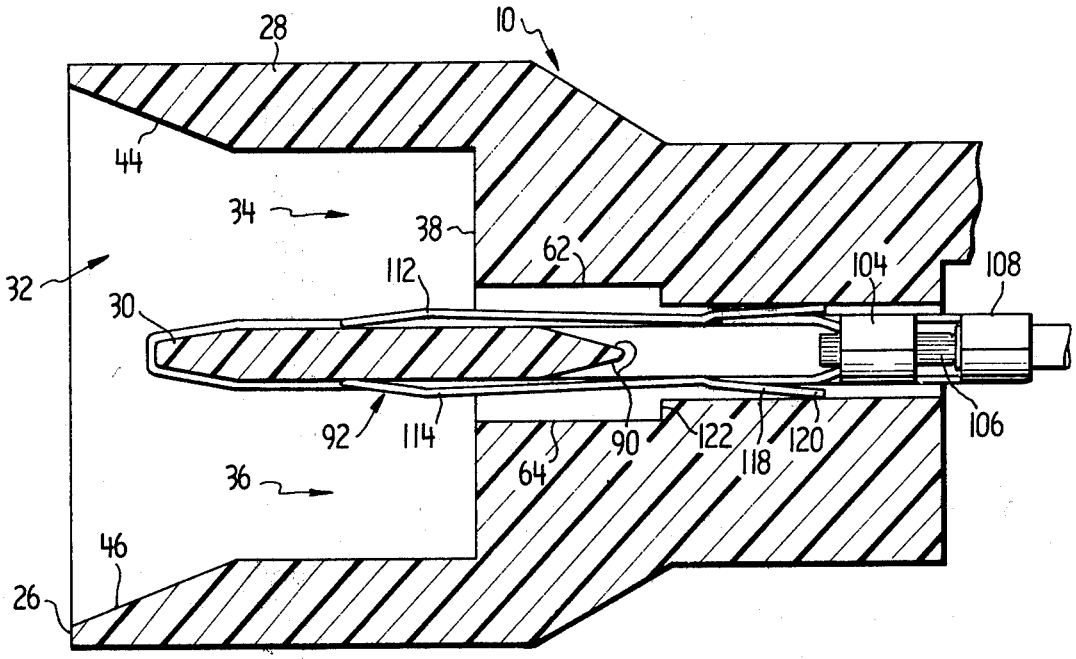
FIG. 7 is a cross-sectional view similar to FIG. 3 showing a second embodiment of a contact member partially inserted into a plug according to the present invention.

To conductively connect a plurality of conductors with a card edge connector 12, a contact member 92 is first attached to each conductor. In connection with the illustrated wire conductor, this is accomplished by exposing a section of each conductor 106 and then attaching the contact member 92 by crimping the crimpable ears 104 disposed at the second end 102 thereof. An electrical connection is thereby established between the contact member 92 and the respective conductor 106. When each conductor has been provided with a contact member 92, the contact members and the attached conductors are inserted into the longitudinal openings 56 of the plug 10. As the first end 95 of the contact member 92 passes through the longitudinal opening 56, the fingers 93, 94 engage the chamferred surfaces 90 of the beam 30. The chamferred surfaces 90 resiliently spread the fingers 93, 94 apart from an initially parallel relationship. As the contact member 92 is pushed further into the plug 10, each finger 93, 94 is received by one groove 86 of a pair of grooves 86 aligned with the openings 56. One groove 86 of the pair is on the generally planar upper surface 82 of beam 30 whereas the other groove 86 of the pair is on the generally planar lower surface 84 of beam 30. At this point, the configuration of a contact member 92 having the embodiment of FIG. 8 resembles the shape illustrated by broken lines in FIG. 3. Similarly, contact member 92 with the embodiment of FIG. 9 resembles the configuration depicted in FIG. 7.

Further insertion of the contact member 92 into the plug 10 results in each contact member 92 having its fingers 93, 94 returned toward the originally parallel configuration with the beam 30 interposed therebetween (see FIGS. 3 and 5).

When the contact members 92 are fully inserted into the plug 10, each contact member 92 is removably retained therein by means of the latching means. In the embodiment illustrated in FIG. 3 the hooks 116 which overlap the front end 88 of beam 30 and are received in notch 87. In the embodiment illustrated in FIG. 5 the buttress members 118 are resiliently urged outward such that one end of the buttress member 118 engages a latching surface 120. With the contact members attached to a plurality of elongate flexible conductors and subsequently inserted into the plug 10, the plug may be connected with a card edge connector 12 completing the connection between the cable and the card edge connector 12.

It will be observed from FIG. 6 that a slot 124 is provided in each projection 61 of beam 30 which extends into the front portion 57 of the opening 56. Since the central portion of each contact member 92 has a substantially U-shaped cross-section (see FIGS. 8 and 9) and since the fingers 93, 94 are preferably parallel, with a flat transverse cross-sectional configuration (see Fig. 4), the slot 124 accommodates the cross-section discontinuity therebetween. The stop provided by the slot 124 acts as a positive stop for the contact in the direction of forward movement, i.e. the contact insertion direction.

Generally, the fingers 93, 94 are provided with the flat transverse cross-section as illustrated in FIG. 4 because it makes the fingers 93, 94 of the contact members 92 less susceptible to damage from foreign objects which may accidentally be inserted into the connector receiving cavity 32.

The beam 30 with associated contacts might be inserted into a card edge connector such that surface 38 would limit the depth of penetration of the beam 30 into the card edge connector 12.

In the event that fingers 93, 94 of any one contact member 92 become damaged, it is possible to remove that contact member 92 from the plug 10 without removing all other contact members. For the embodiment ilustrated in FIG. 3 removal is readily obtained by spreading the fingers 93, 94 sufficiently apart to enable the hook means 116 to clear the front end 88 of the beam 30. For the embodiment illustrated in FIG. 5 removal of a contact member is made possible by resiliently bending inwardly the second end 120 of each buttress member 118 such that the contact member 92 may be withdrawn through longitudinal opening 56 (see FIG. 7).

It will now be appreciated that in constructing a connection between a plurality of elongate flexible conductors and a card edge connector according to the present invention, many significant advantages are provided.

In particular, a simple and efficient power connection to a back panel is facilitated.

Also, rapid engagement and disengagement of the conductors is readily available. Moreover, an insulated connection between each conductor and the mating receptacle is obtained.

The use of a one piece housing for the plug eliminates the need to position contacts and subsequently assemble portions of the housing. Accordingly, there are fewer parts to assemble.

The generally planar beam with its associated grooves permits uniform alignment of contact members within the plug. The generally planar beam also separates fingers of the bifurcated contact member to aid the insertion thereof into the plug. In one embodiment, the beam itself provides a locking surface which resilient fingers of the contacts engage to inhibit accidental dislocation from the plug. The generally planar beam guides all the contact members simultaneously into connection with the card edge connector. Furthermore, the planar beam permits contact members to be positioned on both planar sides thereof for redundant electrical contact between the cable and the card edge connector.

By recessing the generally planar beam from the open end of a shroud, additional protection from accidental injury is provided for the exposed fingers of the contact members.

The use of crimpable contacts for wire conductors and the like provides an advantage in that a fast, inexpensive procedure may be used to connect the individual contact members with the multiconductor cable. By machine crimping each contact member to its associated conductor a uniform electrical contact is established therebetween while simultaneously eliminating the need for soldering.

The ability to selectively remove individual members enables the user of the invention to replace broken or deformed contact members without requiring replacement of all contact members and without replacing the entire plug. This removable feature of the contacts also allows inspection of the electrically conducting connection between a contact member and its associated conductor.

The bifurcated contact members which have a pair of fingers facilitate a redundant electrical connection between each conductor and the associated card edge connector.

By providing each of the bifurcated fingers with a flat cross-section a lower resistance to insertion forces is made possible between the plug and the card edge connector.

As will be appreciated, although the present invention has been described specific conjunction with a plurality of elongate flexible conductor means provided in the form of a plurality of wires, the invention has applicability where the plurality of elongate flexible conductor means are part of flexible flat conductor cable, flexible etched circuitry, ribbon or wire cable, etc. Suitable modification for connecting the contact of the present invention may be made in the case of flat conductor cable or flexible etched circuitry, or where otherwise appropriate.

Thus, it is apparent that there has been provided in accordance with this invention, a plug that substantially satisfies the objects and advantages set forth above.

Although the present invention has been described in conjunction with specific embodiments thereof it is evident that many alternatives, modifications, variations and equivalents will be apparent to those skilled in the art in light of the foregoing disclosure. Accordingly, it is expressly intended that all such alternatives, modifications, variations and equivalents which fall within the spirit and scope of the invention as defined in the appended claims are embraced thereby.

What is claimed is:

1. A plug for conductively connecting a plurality of flexible conductors to a card edge type connector with a connector housing having a longitudinal opening and carrying a plurality of spaced connector contacts along the opening, said plug comprising:

an insulating housing including a shroud defining a connector receiving recess;

an elongate, substantially planar beam contained within said recess and spaced proximately from the edge of said shroud and receivable in said generally longitudinal opening of said card edge type connector, said planar beam including a pair of substantially planar surfaces situated substantially parallel to one another on opposite sides of said beam, said substantially planar surfaces being chamfered on one edge to facilitate insertion of said connector contacts into said housing and over said planar beam; said substantially planar surfaces further including a plurality of grooves for receiving and aligning said connector contacts;

a plurality of longitudinally spaced access openings in said plug housing generally aligned with the grooves on said beam;

a plurality of flexible conductors; and a plurality of longitudinally spaced, removable, electrically conductive contact members each associated with a respective one of said flexible conductors and receivable through said access openings, said contact members being releasably connected to said plug housing and comprising:

connecting means for connection to a respective one of said plurality of flexible conductors, said connecting means comprising at least one crimpable member integrally connected to one end of each of said contact members, and a pair of springy fingers having free outer ends and projecting from said connecting means on each of said planar surfaces of said beam in straddling relation to said beam.

2. The plug according to claim 1 wherein:

said contact members are releasably connected to said plug housing by curved portions of the free ends of said fingers which engage said beam.

3. The plug according to claim 1 wherein:

said contact members are releasably connected to said plug housing by at least one resilient lance member integral with a contact finger and resiliently engaging said housing.

4. The plug according to claim 3 wherein:

one end of said lance member is integral with said contact member and a second end of said lance member is spaced outwardly from said contact member for engaging said housing and wherein said first end includes stress relief means.

5. An electrical connector comprising:

a card edge type connector comprising an elongate housing having a plurality of spaced contacts disposed adjacent a generally longitudinal receiving opening;

a plug assembly mating with said card edge type connector and including:

an insulating housing including a shroud defining a connector receiving recess;

an elongate, substantially planar beam contained within said recess and spaced proximately from the edge of said shroud and received in said generally longitudinal opening of said card edge type connector, and including a pair of substantially planar surfaces situated substantially parallel to one another on opposite sides of said beam, said substantially planar surfaces being chamfered on one edge to facilitate insertion of said connector contacts into said housing and over said planar beam, said substantially planar surfaces further including a plurality of grooves for receiving and aligning said connector contacts;

a plurality of flexible conductors;

a plurality of longitudinally spaced, removable, electrically conductive contact members each associated with a respective one of said flexible conductors, said contact members being releasably connected to said plug assembly housing, said contact members comprising:

connecting means for connection to a respective one of said plurality of flexible conductors, said connecting means comprising at least one crimpable member integrally connected to one end of each of said contact members; and a pair of springy fingers having free outer ends and projecting from said connecting means on each of said planar surfaces of said beam in straddling relation to said beam, at least one finger of plural longitudinally spaced pairs of said fingers engaging longitudinally spaced ones of said spaced contacts disposed adjacent said receiving openings of said card edge type connector.

6. A method of conductively connecting a plurality of conductors with a card edge connector comprising the steps of:

connecting an electrically conducting contact having a pair of fingers to each of said conductors by crimping one end of the electrically conducting contact around said conductor;

releasably securing each of said contacts to a housing to form a structure similar to a conventional printed circuit card by:

inserting each contact into said housing through an access opening located in a rear portion of said housing;

spreading said pair of fingers by pushing each contact longitudinally onto a beam section of said housing;

returning the fingers of each contact to an original configuration with the beam section interposed therebetween;

aligning said fingers in parallel relation along opposite sides of said beam section;

removably attaching a portion of each contact with a portion of said housing to prevent unintentional dislocation of said contacts; and inserting said beam section into said card edge connector to electrically couple said contacts with mating contact elements of said card edge connector.

* * * * *